US005389227A

United States Patent [19]

Matyi et al.

[11] Patent Number: 5,389,227

[45] Date of Patent: Feb. 14, 1995

[54] ELECTROFORMING MANDRELS

[75] Inventors: Ernest F. Matyi, Webster; William G. Herbert, Williamson; Gary J. Maier; Loren E. Hendrix, both of Webster, all of N.Y.

[73] Assignee: Xerox Corporation, Stamford, Conn.

[21] Appl. No.: 157,557

[22] Filed: Nov. 26, 1993

[51] Int. Cl.[6] ..... C25D 1/02

[52] U.S. Cl. ..... 205/73; 72/345; 164/46; 164/132; 264/335; 425/437; 425/438

[58] Field of Search ..... 205/67, 73; 72/344, 72/345; 164/132, 46; 264/334, 335; 425/437, 438

[56] References Cited

U.S. PATENT DOCUMENTS 4,711,833 12/1987 McAneney et al. ..... 430/131
4,902,386 2/1990 Herbert et al. ..... 204/9
5,021,109 6/1991 Petropoulos et al. ..... 156/137
5,064,509 11/1991 Melnyk et al. ..... 204/9

*Primary Examiner*—John Niebling
*Assistant Examiner*—Edna Wong
*Attorney, Agent, or Firm*—Zosan S. Soong

[57] ABSTRACT

Methods and apparatus for separating a mandrel having a tapered end portion from an article formed thereon comprising: (a) providing the mandrel having an opening in the tapered end portion; (b) plugging at least a substantial portion of the opening with a member which presents a deposition surface for the formation of the article; (c) forming the article having a tapered end portion on the mandrel, including on the deposition surface of the member; and (d) pushing the member against the inside surface of the tapered end portion of the article to move the article away from the mandrel, thereby forming a gap between the article and the mandrel.

20 Claims, 4 Drawing Sheets

ELECTROFORMING MANDRELS

This invention relates generally to apparatus and methods for separating a mandrel from an article formed thereon. More particularly, the present invention relates to apparatus and methods which separate the mandrel and the article by providing means for moving, pushing, or exerting force against the inside surface of the article. The removed electroformed article may be used for example as a substrate in the fabrication of photoreceptors.

Parting of the electroform from the mandrel typically occurs by hand with the worker gripping the central portion of the electroform during parting. This is disadvantageous since one or more of the following may occur: contamination of the electroform surface such as by dirty or contaminated gloves; marring the finish (matte finish is typically employed to eliminate the plywood phenomenon); scratching or denting the electroform surface; rendering parting more difficult by gripping the electroform which reduces any parting gap between the electroform and the mandrel; and physical damage to the mandrel. There is a need for new separation methods which minimize or eliminate one or more of the above described problems, and this need is met by the present invention.

Various apparatus and methods for separating a mandrel from an article formed thereon are known:

Petropoulos et al., U.S. Pat. No. 5,021,109, discloses in col. 11 a number of separation methods involving for example the use of vacuum cups and the introduction of a fluid between the substrate and the mandrel.

Melnyk et al., U.S. Pat. No. 5,064,509, discloses in col. 12, line 65 to col. 13, line 22, a number of separation methods involving for example the introduction of a fluid between the substrate and the mandrel.

McAneney et al., U.S. Pat. No. 4,711,833, discloses in col. 10, lines 30–40, the separation of a belt from a mandrel by blowing air through holes in a cylindrical mandrel after removal of removable plugs from the mandrel.

Herbert et al., U.S. Pat. No. 4,902,386, discloses a mandrel having an ellipsoid shaped end.

SUMMARY OF THE INVENTION

It is an object of the present invention in embodiments to employ electroform parting methods which minimize or eliminate one or more of the following: contamination of the electroform surface such as by dirty or contaminated gloves; marring the finish (matte finish is typically employed to eliminate the plywood phenomenon); scratching or denting the electroform surface; making parting more difficult by gripping the electroform which reduces any parting gap between the electroform and the mandrel; and physical damage to the mandrel.

It is another object in embodiments to select materials for the mandrel and the electroformed article having similar or different coefficients of expansion.

It is a further object in embodiments to employ mandrels having a tapered end portion.

These objects and others are accomplished in embodiments by providing a method for separating a mandrel from an article formed thereon comprising: (a) providing the mandrel having an opening in a tapered end portion; (b) plugging a portion of the opening with a member which presents a deposition surface for the formation of the article; (c) forming the article having a tapered end portion on the mandrel, including on the deposition surface of the member; and (d) moving the member against the inside surface of the tapered end portion of the article to move the article away from the mandrel, thereby forming a gap between the article and the mandrel.

There is further provided in embodiments a mandrel comprising: (a) side walls defining therebetween a passageway; (b) a tapered end portion formed by a tapering of the sidewalls and having an opening on the surface of the end portion, wherein the passageway extends into the tapered end portion and is in communication with the opening; and (c) a member, disposed in the passageway, which plugs at least a substantial portion of the opening and presents an electrically conductive contact surface for the formation of the article.

BRIEF DESCRIPTION OF THE DRAWINGS

Other aspects of the present invention will become apparent as the following description proceeds and upon reference to the Figures which represent preferred embodiments.

DETAILED DESCRIPTION

Figure 1:
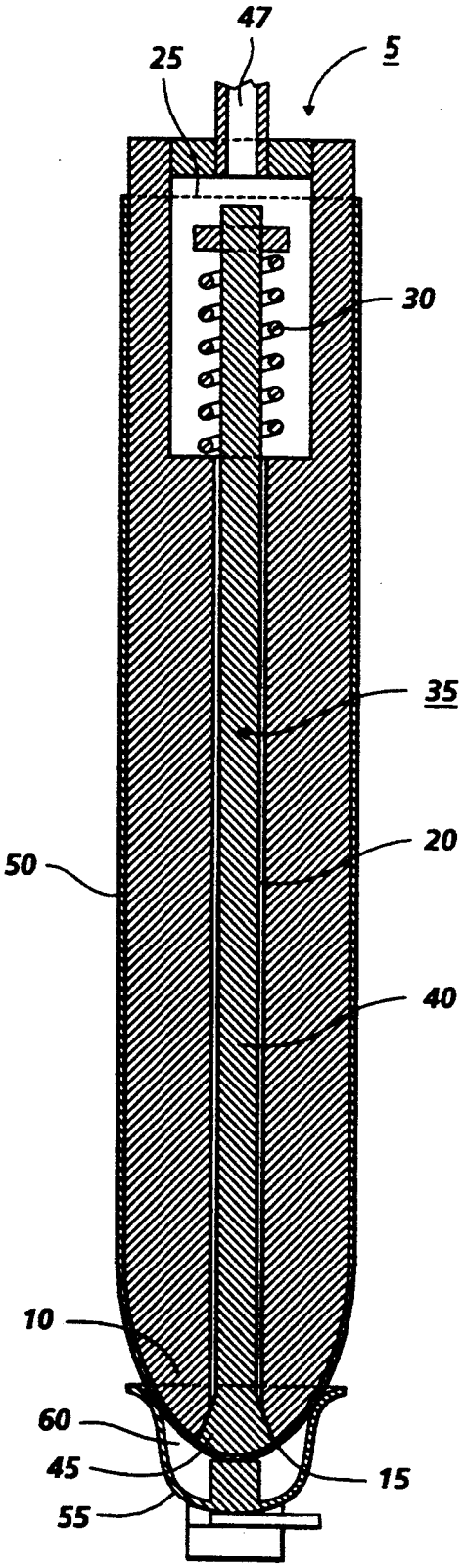
FIG. 1 illustrates a schematic, elevational view of one embodiment of the present invention.

FIG. 1 illustrates mandrel 5 having tapered end portion 10. Opening 15 is present at the tip of tapered end portion 10 which is in communication with passageway 20. The portion of passageway 20 adjacent opening 15 is flared. Chamber 25, which contains spring device 30, is in communication with passageway 20. Push member 35, disposed in passageway 20 and chamber 25, is comprised of rod 40 and integral end portion 45, which may be flared. Member 35 is coupled on one end to spring device 30, the coupling maintaining the position of member 35 within mandrel 5. The bottom surface of end portion 45 is flush with the rim of opening 15 and is curved in conformance with the contour of tapered end portion 10 of mandrel 5. Electroform or article 50 is formed on the surface of mandrel 5, including on the bottom surface of end portion 45 of push member 35. Optional vacuum cup 55 adheres to the surface of article 50 to support article 50 during its movement away from mandrel 5. Chamber 25 and passageway 20 may already contain a fluid such as air. Inlet 47 permits entry of additional fluid into chamber 25.

Figure 2:
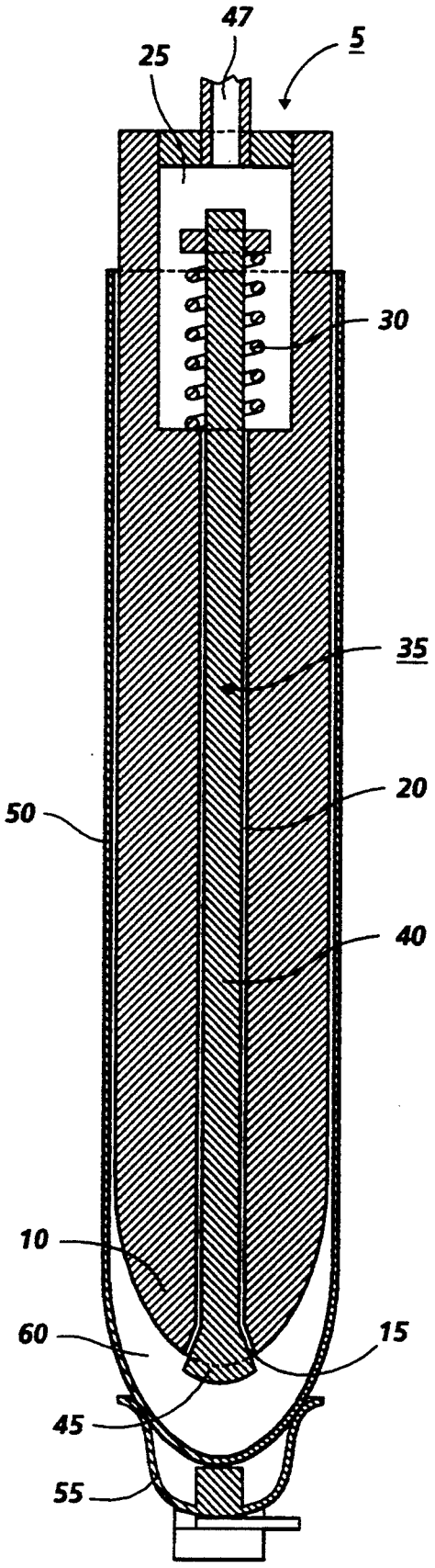
FIG. 2 illustrates a schematic, elevational view of the embodiment of FIG. 1 in operation to separate the mandrel from the article formed thereon.

FIG. 2 discloses the operation of the apparatus shown in FIG. 1. In FIG. 2, fluid enters through inlet 47 into chamber 25 to activate spring device 30. Activated spring device 30 pushes end portion 45 of member 35 against the inner surface of article 50, thereby creating gap 60 between article 50 and mandrel 5. Push member 35 pushes the inner surface of article 50 in the direction of separation to the limit of spring device 30. When spring device 30 is fully compressed, movement of article 50 in the direction of separation continues by the pressure exerted by fluid which fills gap 60 between article 50 and mandrel 5 to maintain pressure against the inner surface of article 50. Fluid flow through inlet 47, chamber 25, and passageway 20 into gap 60 is accomplished in embodiments by providing that rod 40 is preferably narrower than passageway 20 so that movement of the bottom of end portion 45 beyond the rim of opening 15 allows fluid from passageway 20 to fill gap 60 between mandrel 5 and article 50, thereby assisting separation. During separation, fluid may exit out from the top of article 50.

Figure 3:
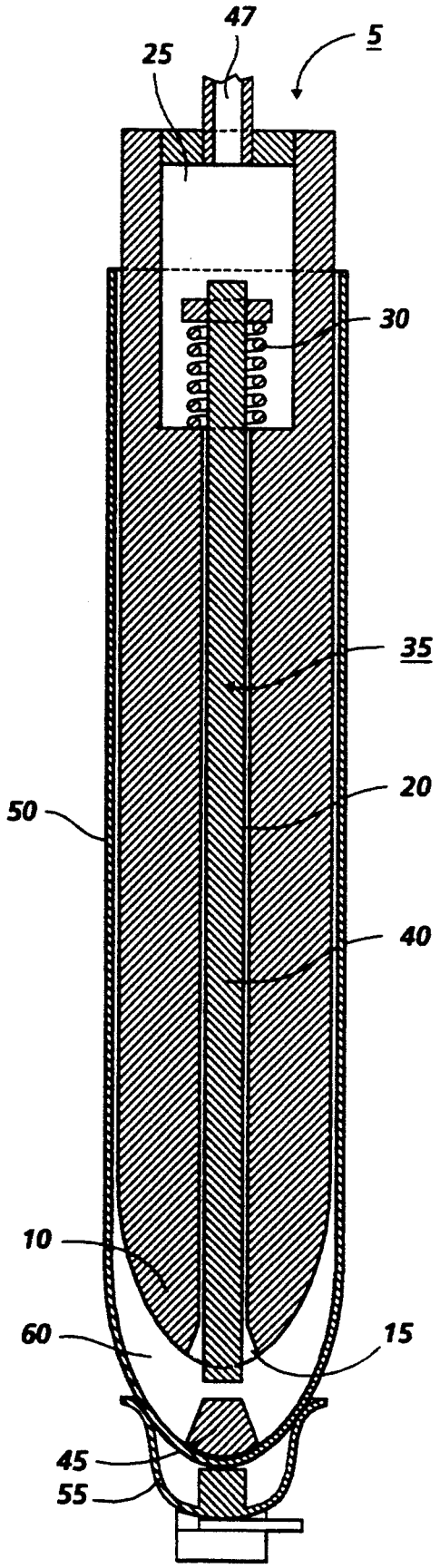
FIG. 3 illustrates a schematic, elevational view of a modified embodiment of the apparatus depicted in FIG. 1.

FIG. 3 discloses the operation of a modified embodiment of the apparatus shown in FIG. 1, wherein push member 35 is comprised of rod 40 and detached end portion 45, which may be flared. In embodiments, separate end portion 45 may be in the form of a wedge shaped plug. End portion 45 may be for example hammered into position. The operation of the apparatus of FIG. 3 is similar to that of the apparatus of FIG. 1. In FIG. 3, additional fluid enters through inlet 47 into chamber 25 to activate spring device 30. Activated spring device 30 pushes rod 40 against end portion 45 and end portion 45 in turn pushes against the inner surface of article 50, thereby creating gap 60 between article 50 and mandrel 5. Rod 40 and end portion 45 pushes the inner surface of article 50 in the direction of separation to the limit of spring device 30. When spring device 30 is fully compressed, movement of article 50 in the direction of separation continues by the pressure exerted by fluid which fills gap 60 between article 50 and mandrel 5 to maintain pressure against the inner surface of article 50. Fluid flow through inlet 47, chamber 25, and passageway 20 into gap 60 is accomplished in embodiments by providing that rod 40 is preferably narrower than passageway 20 so that movement of end portion 45 beyond the rim of opening 15 allows fluid from passageway 20 to fill gap 60 between mandrel 5 and article 50, thereby assisting separation. In FIG. 3, end portion 45 and rod 40 are not coupled together such that when spring device 30 is fully compressed and rod 40 can no longer continue to move in the direction of separation, end portion 45 may become separated from rod 40 and end portion 45 may rest on the inner surface of article 50. Optional vacuum cup 55 adheres to the surface of article 50 to support article 50 during its movement away from mandrel 5. During separation, fluid may exit out from the top of article 50.

Figure 4:
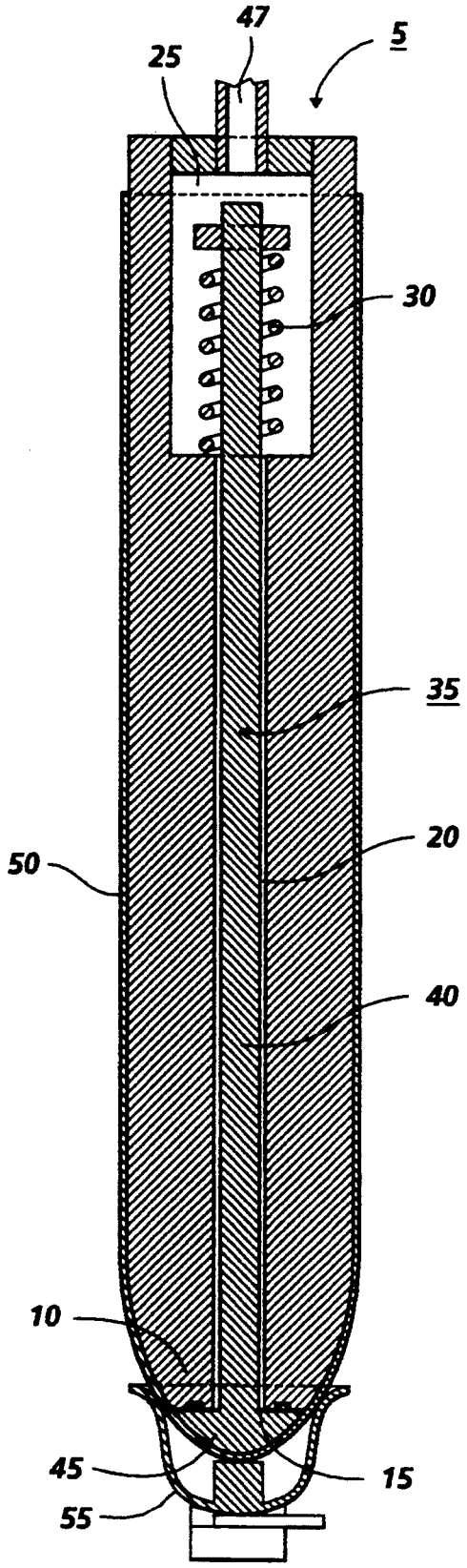
FIG. 4 illustrates a schematic, elevational view of another modified embodiment of the apparatus depicted in FIG. 1.

FIG. 4 discloses another modified embodiment of the apparatus shown in FIG. 1, wherein push member 35 is comprised of rod 40 and an integral bow shaped end portion 45 which extends beyond opening 15 and constitutes the tip of mandrel 5. The operation of the apparatus of FIG. 4 is similar to that of the apparatus of FIG. 1. In FIG. 4, additional fluid enters through inlet 47 into chamber 25 to activate spring device 30. Activated spring device 30 pushes bow shaped end portion 45 against the inner surface of article 50, thereby creating a gap (not shown in this Figure) between article 50 and mandrel 5. Member 35 pushes the inner surface of the article 50 in the direction of separation to the limit of spring device 30. When spring device 30 is fully compressed, movement of article 50 in the direction of separation continues by the pressure exerted by fluid which fills the gap between article 50 and mandrel 5 to maintain pressure against the inner surface of article 50. Fluid flow through inlet 47, chamber 25, and passageway 20 into the gap is accomplished in embodiments by providing that rod 40 behind bow shaped end portion 45 is preferably narrower than passageway 20 so that movement of end portion 45 beyond the rim of opening 15 allows fluid from passageway 20 to fill the gap between mandrel 5 and article 50, thereby assisting separation. During separation, fluid may exit out from the top of article 50.

Figure 5:
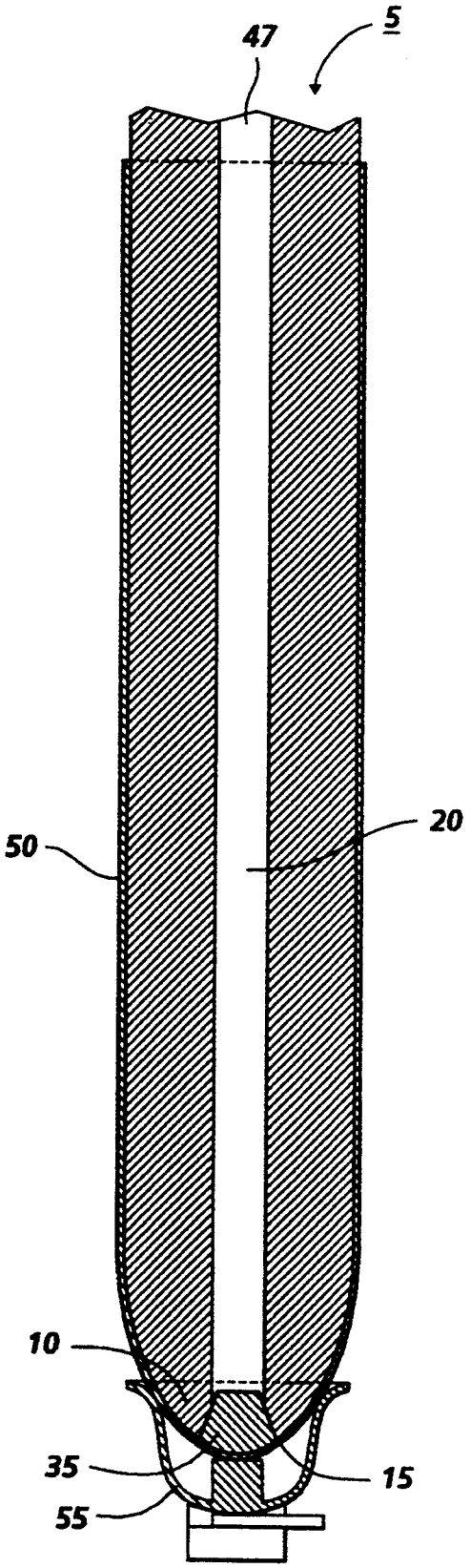
FIG. 5 illustrates a schematic, elevationai view of another embodiment of the present invention.

FIG. 5 discloses mandrel 5 having tapered end portion 10. Opening 15 is present at the tip of tapered end portion 10 which is in communication with passageway 20 which extends through the length of mandrel 5. The portion of passageway 20 adjacent opening 15 may be flared to accommodate push member 35 which preferably is in the form of a wedge shaped plug. Push member 35 may be for example hammered into position. Inlet 47 permits entry of fluid into passageway 20. The bottom surface of member 35 may be flush with the rim of opening 15 and may be curved in conformance with the contour of the tapered end portion 10. Article 50 is formed on the surface of mandrel 5, including on the bottom surface of member 35. Optional vacuum cup 55 adheres to the surface of article 50 to support article 50 during its movement away from the mandrel 5. In FIG. 5, additional fluid enters through inlet 47 into passageway 20 to press member 35 against the inner surface of article 50, thereby creating a gap (not shown in this Figure) between article 50 and mandrel 5. Member 35 is free of coupling to any other device such that when the flow of fluid urges member 35 completely beyond the rim of opening 15, member 35 may drop to rest against the inner surface of the tapered end portion 10 of mandrel 5. Movement of article 50 in the direction of separation continues by the pressure exerted by fluid which fills the gap between article 50 and mandrel 5 to maintain pressure against the inner surface of article 50. During separation, fluid may exit out from the top of article 50.

In those embodiments which employ a device such as a spring device to initiate movement of the push member, the device may be reset after parting of the mandrel and the article by any appropriate method such as by withdrawing fluid from the interior of the mandrel. Suitable methods and apparatus besides a fluid activated spring device may be employed to initiate movement of the push member against the inner surface of the article including mechanical and/or electrical components such as a cam, a solenoid, or a combination of both.

In the embodiments disclosed herein, it is preferred that the tapered end portions of mandrel and article are pointing downwards so that gravity may assist their separation.

The mandrel may have any effective design. In embodiments, there are a plurality of openings such as two, three, four or more openings at the tapered end portion of the mandrel. The mandrel may have any effective cross-sectional shape such as cylindrical, oval, square, rectangular, or triangular. In embodiments, the mandrel has tapered sides. A preferred mandrel has an ellipsoid or parabolic shaped end portion, with the mandrel profile preferably like that illustrated in Herbert et al., U.S. Pat. No. 4,902,386, the disclosure of which is totally incorporated by reference. Such a mandrel with an ellipsoid or parabolic shaped end portion is preferred since the resulting electroform will have a corresponding ellipsoid or parabolic shaped end portion which provides a gripping surface. Any damage to the ellipsoid or parabolic shaped end portion of the electroform during parting is generally of no consequence since the end portion may be discarded, such as by cutting off, in the processing of photoreceptor substrates. The top end of the mandrel may be open or closed, flat or of any other suitable design. The mandrel may be of any suitable dimensions. For example, the mandrel may have a length ranging from about 5 cm to about 100 cm; and an outside diameter ranging from about 5 cm to about 30 cm. The mandrel may be fabricated from any suitable material, preferably a metal such as aluminum, nickel, steel, iron, copper, and the like.

The mandrel may be optionally plated with a protective coating. Typical plated protective coatings for mandrels include chromium, nickel, alloys of nickel, iron, and the like. The plated metal should preferably be harder than the metal used to form the electroform and is of an effective thickness of for example at least 0.006 mm in thickness, and preferably from about 0.008 to about 0.05 mm in thickness. The outer surface of the plated mandrel preferably is passive, i.e., adhesive, relative to the metal that is electrodeposited to prevent adhesion during electroforming. Other factors that may be considered when selecting the metal for plating include cost, nucleation, adhesion, oxide formation and the like. Chromium plating is a preferred material for the outer mandrel surface because it has a naturally occurring oxide and surface resistive to the formation of a strongly adhering bond with the electro-deposited metal such as nickel. However, other suitable metal surfaces could be used for the mandrels. The mandrel may be plated using any suitable electrodeposition process. Processes for plating a mandrel are known and described in the patent literature. For example, a process for applying multiple metal platings to an aluminum mandrel is described in U.S. Pat. Nos. 4,067,782, and 4,902,386, the disclosures of which are totally incorporated by reference.

Chamber 25, passageway 20, and opening 15 may be of any effective dimensions. For example, the passageway may have a width ranging from about 10 mm to about 5 cm, and preferably from about 20 mm to about 3 cm and a length preferably ranging from about 10 cm to about 100 cm. The chamber may have a dimension ranging for instance from about 10 cc to about 50 cc. The chamber and passageway preferably run along the entire length of the mandrel. The one or more openings may be any suitable shape including circular, square, oval, and the like. The size of the one or more openings may range for example from about 10 mm to about 5 cm, and preferably from about 20 mm to about 3 cm. The one or more openings may be located anywhere on the surface of the tapered end portion of the mandrel, and preferably is located at the tip of the tapered end portion.

The push member may be made of any suitable material. Since the article is formed over the bottom of the member, a portion of the member, preferably the entire member, may be fabricated from an electrically conductive material such as a metal like steel, iron, nickel, copper, or aluminum. In embodiments, the member or the end portion thereof may be entirely straight sided. However, the push member or end portion thereof preferably has a wedge shape, a flared configuration, or a bow shape. In embodiments, the push member plugs at least a substantial portion of the opening, preferably ranging from about 70 to 100% the width of the opening, more preferably from about 90 to 100% of the width of the opening, and especially 100% the width of the opening. In those embodiments in which the push member is comprised of a rod shaped element (FIGS. 1,2,3,4), the rod shaped element has a width which preferably ranges from about 10 to about 95% the width of the passageway, and more preferably ranges from about 30 to about 70% the width of the passageway. In embodiments, the rod shaped element has a width ranging for example from about 10 mm to about 5 cm and a length ranging for example from about 5 cm to about 50 cm. Where the member is in the form of a plug or where the member comprises an end portion, the end portion and the plug shaped member may be of any suitable dimensions: a cross sectional dimension ranging for example from about 3 cm to about 20 cm; a length ranging for example from about 3 cm to about 15 cm; and an optional taper ranging for example from about 0.1 mm to about 1 mm per mm of length. In embodiments, the push member or a portion thereof may be hollow or solid. Prior to formation of the article on the mandrel, the bottom surface of the member preferably is flush with the rim of the opening such that the sides of the member do not extend beyond the rim of the opening. The bottom surface of the member is preferably curved in conformance with the contour of the tapered end region. In embodiments, the sides of the member may extend beyond the rim of the opening by a length ranging for example from about 2 mm to about 3 cm.

The injected fluid may be a suitable gas including mixtures of different gases, a liquid including mixtures of different liquids, or a mixture of a gas and a liquid. Where mixtures of different gases, different liquids, or a gas and a liquid are employed, the components may be in any effective ratio, and preferably are in equal proportions. Preferred gases include air, carbon dioxide, and nitrogen. Preferred liquids include water such as deionized water, alcohol, wetting agent, or a mixture thereof. Suitable wetting agents, which lower the surface tension, include sodium lauryl sulfate, DUPONOL 80 TM, a sodium alcohol sulfate, PETROWET R TM, a sodium hydrocarbon sulfonate (said latter two surfactants being available from E. I. du Pont de Nemours & Co., Inc.). In embodiments where the wetting agent is employed with for example water, the wetting agent is used in a preferred amount of about 1 gram to about 500 grams of wetting agent per liter of water. Any effective amount of the fluid may be employed, and preferably ranging for example from about 50 grams to about 50 kilograms. Fluid may be introduced by any suitable apparatus including an air pump. The fluid introduction rate could range for example from about 25 cc/minute to about 5,000 cc/minute. The fluid pressure that is employed to remove the electroform or article may range for example from about 1 pound per square inch ("psi") to about 100 psi.

Articles may be formed on the mandrels of this invention by any suitable known process, preferably electroforming. The electroformed articles may be of any effective thickness, preferably from about 1 mm to about 2 cm, and more preferably from about 2 mm to about 20 mm. The electroforming material and the electroformed articles may be of any suitable metal including nickel, copper, iron, steel, or aluminum. In embodiments, the article may fail to completely cover the bottom surface of the member exposed to the deposition solution. In other words, the article may have a hole in its tapered end portion. However, the present invention will be effective in separating the article from the mandrel when the push member has a sufficient area of the inner surface of the article to push against. In embodiments, the instant invention is effective in separating the mandrel and the article even where there is a hole in the article exposing for example from about 1 to about 70% of the surface area of the member exposed to the deposition solution. Preferably, the article covers all of the surface of the member exposed to the deposition solution, which in embodiments, may be the bottom of the member.

Processes for electroforming articles on the mandrel are known and described, for example, in U.S. Pat. Nos. 4,501,646 and 3,844,906, the disclosures of which are totally incorporated by reference. The electroforming process of this invention may be conducted in any suitable electroforming device. For example, a plated cylindrically shaped mandrel having an ellipsoid shaped end portion may be suspended vertically in an electroplating tank. The electrically conductive mandrel plating material should be compatible with the metal plating solution. For example, the mandrel plating may be chromium. The top edge of the mandrel may be masked off with a suitable non-conductive material, such as wax to prevent deposition. The electroplating tank is filled with a plating solution and the temperature of the plating solution is maintained at the desired temperature such as from about 45° to about 65° C. The electroplating tank can contain an annular shaped anode basket which surrounds the mandrel and which is filled with metal chips. The anode basket is disposed in axial alignment with the mandrel. The mandrel is connected to a rotatable drive shaft driven by a motor. The drive shaft and motor may be supported by suitable support members. Either the mandrel or the support for the electroplating tank may be vertically and horizontally movable to allow the mandrel to be moved into and out of the electroplating solution. Electroplating current such as from about 25 to about 400 amperes per square foot can be supplied to the electroplating tank from a suitable DC source. The positive end of the DC source can be connected to the anode basket and the negative end of the DC source connected to a brush and a brush/split ring arrangement on the drive shaft which supports and drives the mandrel. The electroplating current passes from the DC source to the anode basket, to the plating solution, the mandrel, the drive shaft, the split ring, the brush, and back to the DC source. In operation, the mandrel is lowered into the electroplating tank and continuously rotated about its vertical axis. As the mandrel rotates, a layer of electroformed metal is deposited on its outer surface. When the layer of deposited metal has reached the desired thickness, the mandrel is removed from the electroplating tank.

Any suitable method and apparatus may be optionally employed to assist in the removal of the electroformed article from the mandrel. For example, a mechanical parabolic end parting fixture may be employed to grasp the preferably parabolic shaped end of the electroform. The grasping jaws may have as few as three fingers or may completely contact the electroform circumference like a lathe collet. Alternatively, a vacuum cup may be placed under the preferably parabolic shaped end of the mandrel. A vacuum would be generated by the use of air pressure or vacuum pump. In another approach, the electroform/mandrel composite structure is inserted into an induction coil and by energizing the coil the electroform is heated and consequently enlarges, thereby loosening it from the mandrel. In a different approach, vibrational energy, especially ultrasonic energy, is used to cause the electroform to separate from the mandrel. In one embodiment, an ultrasonic bath is used during or after the parting gap is established to assist in removal of the electroform. It is also possible to use a vibrator which contacts the electroform or the mandrel.

In embodiments, an optional effective parting gap may be created between a portion of the electroform and the mandrel to facilitate separation before parting by methods of the instant invention. Preferably, the parting gap ranges from about 0.1 mm to about 1 cm, and more preferably from about 0.1 mm to about 5 mm in width separating the electroform and the mandrel. The parting gap may be created by any suitable method including reliance on differences in the coefficients of thermal expansion/cooling between the mandrel and the article as illustrated in Bailey et al., U.S. Pat. No. 3,844,906 and Herbert, U.S. Pat. No. 4,501,646, the disclosures of which are totally incorporated by reference.

Other modifications of the present invention may occur to those skilled in the art based upon a reading of the present disclosure and these modifications are intended to be included within the scope of the present invention.

We claim:

1. A method for separating a mandrel from an article formed thereon comprising:

(a) providing the mandrel having an opening in a tapered end portion;

(b) plugging a portion of the opening with a member which presents a deposition surface for the formation of the article;

(c) forming the article having a tapered end portion on the mandrel, including on the deposition surface of the member; and (d) moving the member against the inside surface of the tapered end portion of the article to move the article away from the mandrel, thereby forming a gap between the article and the mandrel.

2. The method of claim 1, wherein the member in step (b) plugs a substantial portion of the opening.

3. The method of claim 1, wherein the member in step (b) completely plugs the opening.

4. The method of claim 1, wherein step (d) comprises introducing a fluid into the mandrel to move the member against the inside surface of the tapered end portion of the article.

5. The method of claim 1, wherein the mandrel defines a passageway in communication with the opening and the member is disposed in the passageway adjacent the opening, and step (d) comprises moving a second member, disposed in the passageway behind the member, against the member, thereby moving the member against the inside surface of the tapered end portion of the article.

6. The method of claim 1, wherein step (d) comprises activating a spring device coupled to the member to move the member against the inside surface of the tapered end portion of the article.

7. The method of claim 1, further comprising (e) filling the gap between the article and the mandrel with a fluid.

8. The method of claim 1, further comprising (f) supporting the article during movement of the article away from the mandrel.

9. A mandrel comprising:

(a) side walls defining therebetween a passageway;

(b) a tapered end portion formed by a tapering of the sidewalls and having an opening on the surface of the end portion, wherein the passageway extends into the tapered end portion and is in communication with the opening; and (c) a member, disposed in the passageway, which plugs at least a substantial portion of the opening and presents an electrically conductive deposition surface for the formation of the article.

10. The mandrel of claim 9, wherein the member is capable of movement in the passageway.

11. The mandrel of claim 9, wherein the member completely plugs the opening.

12. The mandrel of claim 9, wherein a portion of the member is narrower than the passageway.

13. The mandrel of claim 9, wherein the deposition surface is flush with the rim of the opening.

14. The mandrel of claim 9, wherein the deposition surface curved in conformance with the contour of the tapered end portion.

15. The mandrel of claim 9, wherein the member is in the shape of a rod having an integral flared end portion, wherein the bottom of the flared end portion is flush with the rim of the opening.

16. The mandrel of claim 9, wherein the member is comprised of a rod and an integral bow shaped end portion, wherein the end portion is disposed beyond the opening.

17. The mandrel of claim 9, wherein the member is a wedge shaped plug.

18. The mandrel of claim 9, wherein the member is comprised of a rod and a detached end portion.

19. The mandrel of claim 9, further comprising a fluid activated spring device, coupled to the member.

20. The mandrel of claim 9, further comprising injection means for injecting fluid into the passageway.

* * * * *